United States Patent [19]

Springfield

[11] Patent Number: 4,578,939

[45] Date of Patent: Apr. 1, 1986

[54] CHOKE GUARD FOR TWISTING MACHINE SPINDLE

[75] Inventor: Barry S. Springfield, Chatsworth, Ga.

[73] Assignee: Queen Carpet Corporation, Dalton, Ga.

[21] Appl. No.: 648,364

[22] Filed: Sep. 7, 1984

[51] Int. Cl.[4] ..... D01H 7/86; D01H 7/88; D01H 7/02; D02G 3/00

[52] U.S. Cl. ..... 57/58.36; 57/58.52; 57/58.83; 57/58.84

[58] Field of Search ..... 57/58.3, 58.36, 58.38, 57/58.49, 58.52, 58.72–58.81, 58.83–58.86

[56] References Cited

U.S. PATENT DOCUMENTS

| | | | |
|---|---|---|---|
| 3,640,060 | 2/1972 | Boyer | 57/58.84 |
| 3,731,478 | 5/1973 | Franzen | 57/58.83 X |
| 3,995,418 | 12/1976 | Neyraud | 57/80 |
| 4,117,655 | 10/1978 | Smith | 57/58.83 |
| 4,167,094 | 9/1979 | Verdollin | 57/58.72 |
| 4,168,605 | 9/1979 | D'Agnolo | 57/58.83 X |
| 4,175,717 | 11/1979 | Mathiolon et al. | 242/131 |
| 4,199,929 | 4/1980 | Vessella | 57/279 |
| 4,237,683 | 12/1980 | Mathiolon et al. | 57/58.86 |
| 4,261,164 | 4/1981 | Tardy | 57/58.76 |
| 4,283,907 | 8/1981 | Pelin | 57/58.76 |
| 4,357,792 | 11/1982 | D'Agnolo et al. | 57/58.83 X |
| 4,391,090 | 7/1983 | Charbonnier | 57/279 |

*Primary Examiner*—John Petrakes

*Attorney, Agent, or Firm*—Kerkam, Stowell, Kondracki & Clarke

[57] ABSTRACT

A choke guard for the spindle of a twisting machine for preventing broken yarn from entering the rotating parts of the spindle comprises a cylindrical member disposed coaxially about the spindle so as to extend between the fixed body of the spindle and the rotating spindle disc, the member being connected to the fixed body portion of the spindle and providing a radially extending circular flange which is received within a circular recess of the rotating spindle disc.

10 Claims, 5 Drawing Figures

CHOKE GUARD FOR TWISTING MACHINE SPINDLE

BACKGROUND OF THE INVENTION

This invention relates generally to textile twisting machines for twisting one or more yarns together, and more particularly to guard devices for preventing broken yarn from being wrapped about or withing rotating portions of the machine.

Twisting machines for producing a multi-strand yarn by twisting together multiple strands of yarn are well-known in the textile industry. Generally, twisting machines comprise a rotating disc connected to a hollow rotating shaft of a spindle. The disc has a radial bore in communication with the axial bore of the spindle shaft through which one or more strands of yarn are fed. A stationary carrier is rotatably mounted with respect to the shaft above the spindle disc. Yarn from a bobbin or cone disposed within the carrier is unwound, as by pulling it through an eyelet disposed above the carrier. The yarn exiting the bore of the spindle disc is also fed through the eyelet and is twisted together with the yarn from the bobbin by virtue of the rotation of the disc. Because of the rotation of the disc, the yarn exiting its bore forms a balloon about the bobbin carrier, which precludes the use of a fixed member connected to the machine frame, for example, for maintaining the carrier stationary on the end of the rotating shaft of the spindle. Accordingly, the spindles of twisting machines incorporate various mechanisms such as electromagnetic devices or a mechanical stabilization whorl to immobilize the bobbin carrier with respect to the rotating spindle shaft. Such mechanisms complicate the design of the spindle and make it expensive and time-consuming to repair or rebuild the spindle.

It is not uncommon in a twisting machine for the yarn exiting the rotating spindle disc to break. When breakage occurs, the free end of the yarn can enter the spindle and become wound about its rotating parts causing failure of the spindle and necessitating its being rebuilt. Although spindles are known which employ a guard device comprising a circular somewhat bowl-shaped deflector having an upper edge surrounding the periphery of the spindle disc for deflecting broken thread away from the rotating spindle parts, such deflectors are not entirely satisfactory in their operation, and they have other disadvantages.

Accordingly, it is desirable to provide an improved spindle choke guard which prevents the free end of broken yarn from entering the spindle and which avoids other disadvantages of known guard devices. It is to this end that the present invention is directed.

SUMMARY OF THE INVENTION

The invention provides a simple, effective, and inexpensive choke guard for use with a twisting machine spindle that prevents the free end of broken yarn from entering the spindle and becoming wrapped about its rotating parts, which would interfere with its operation or cause failure. A choke guard in accordance with the invention is more effective than a conventional deflector in accomplishing this, and further serves as a dust cover to prevent dust from entering the spindle which could affect its operation, thereby eliminating the need for a dust cover as employed on known spindles.

Briefly stated, a choke guard in accordance with the invention comprises a guard member that is sized to be disposed about the spindle and to extend between the fixed spindle body and the rotating spindle disc. The guard member has means enabling its connection to the fixed spindle body, and has a radially extending circular portion at one end thereof which is adapted to be disposed within a circular recess in the surface of the spindle disc. The circular portion, which is sized to permit the spindle disc to rotate relative to the guard member, preferably has a thickness such that it is flush with the surface of the disc. This avoids any axial projection upon which the broken end of a yarn may catch. If breakage does occur, the yarn wraps itself about the guard member, from which it may be easily removed, rather than entering the spindle and wrapping itself about the rotating parts thereof necessitating rebuilding of the spindle.

DESCRIPTION OF THE PREFERRED EMBODIMENT

Choke guards in accordance with the invention are particularly intended for use with twisting machines and type "U" and "R" spindles manufactured by Verdol S.A., Calvier, France, such as a type 400 S SFCA CD machine, of the general type illustrated in U.S. Pat. No. 4,175,717 and 4,167,094, and will be described in that context. However, as will be appreciated, choke guards in accordance with the invention may also be employed with other types of machines and spindles.

Figure 1:
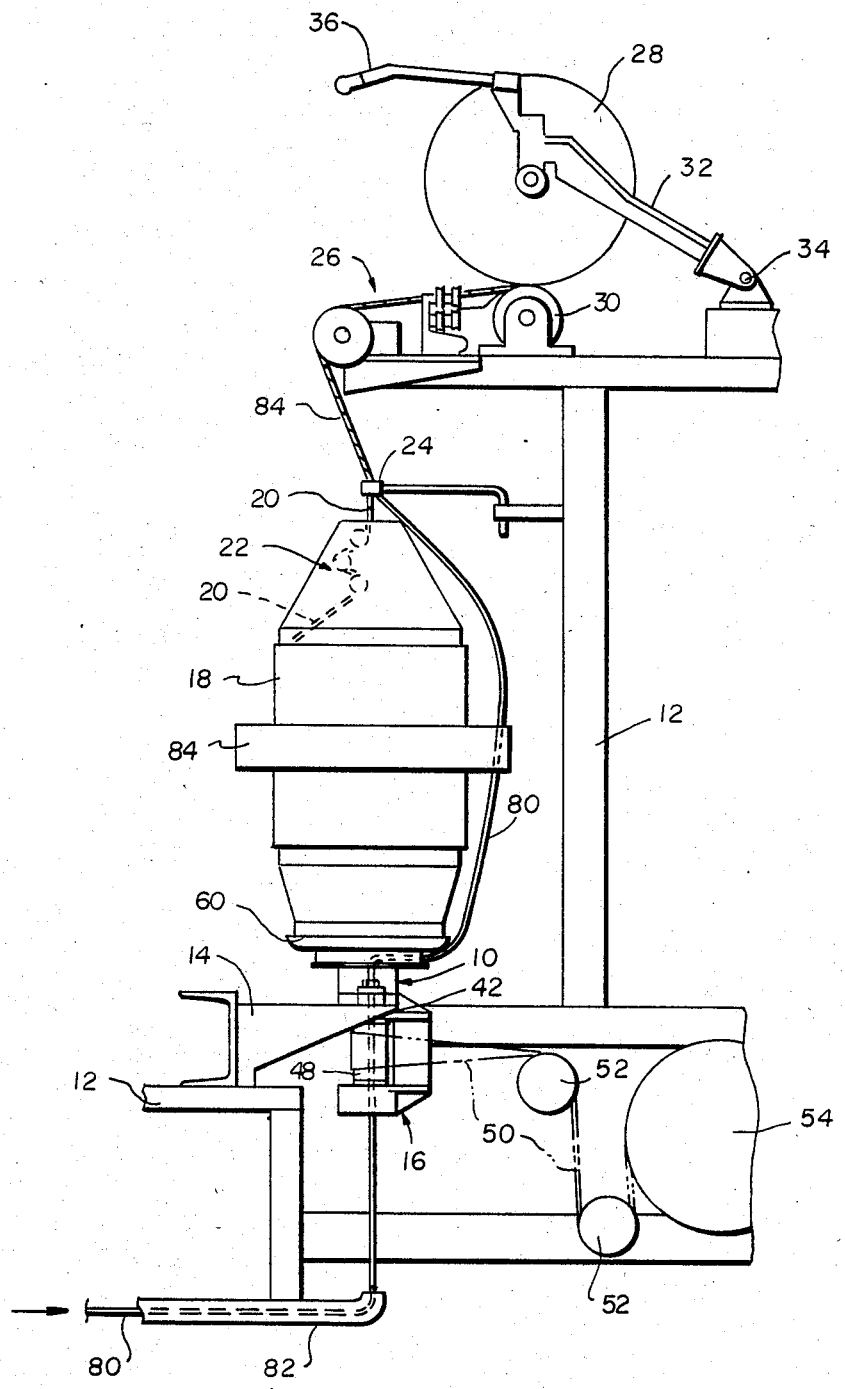
FIG. 1 is a side view of a portion of a twisting machine embodying a choke guard in accordance with the invention.

FIG. 1 illustrates a portion of a twisting machine embodying a choke guard 10 in accordance with the invention. As shown, the machine may generally comprise a frame 12 carrying on a mounting bracket 14 a spindle 16 which supports on its upper end a bobbin carrier 18. The bobbin carrier, which may comprise a cylindrical can or pot, encloses and supports one or more yarn bobbins or cones (not illustrated) within its interior from which yarn 20 may be unwound and drawn upwardly past a series of rollers 22 which constitute a yarn brake or tensioning device. Yarn 20 passes through an eyelet or ring 24 positioned above the carrier, through a known form of an overfeed control mechanism 26, and is wound in a conventional manner upon a drum or yarn cone 28 engaging a cylinder 30. Drum 28 is rotatably supported on the end of a pair of arms 32 (only one being illustrated in the figure) which are pivotally connected to frame 12 at 34. An actuating lever 36 enables the drum to be lifted with respect to cylinder 30.

Figure 4:
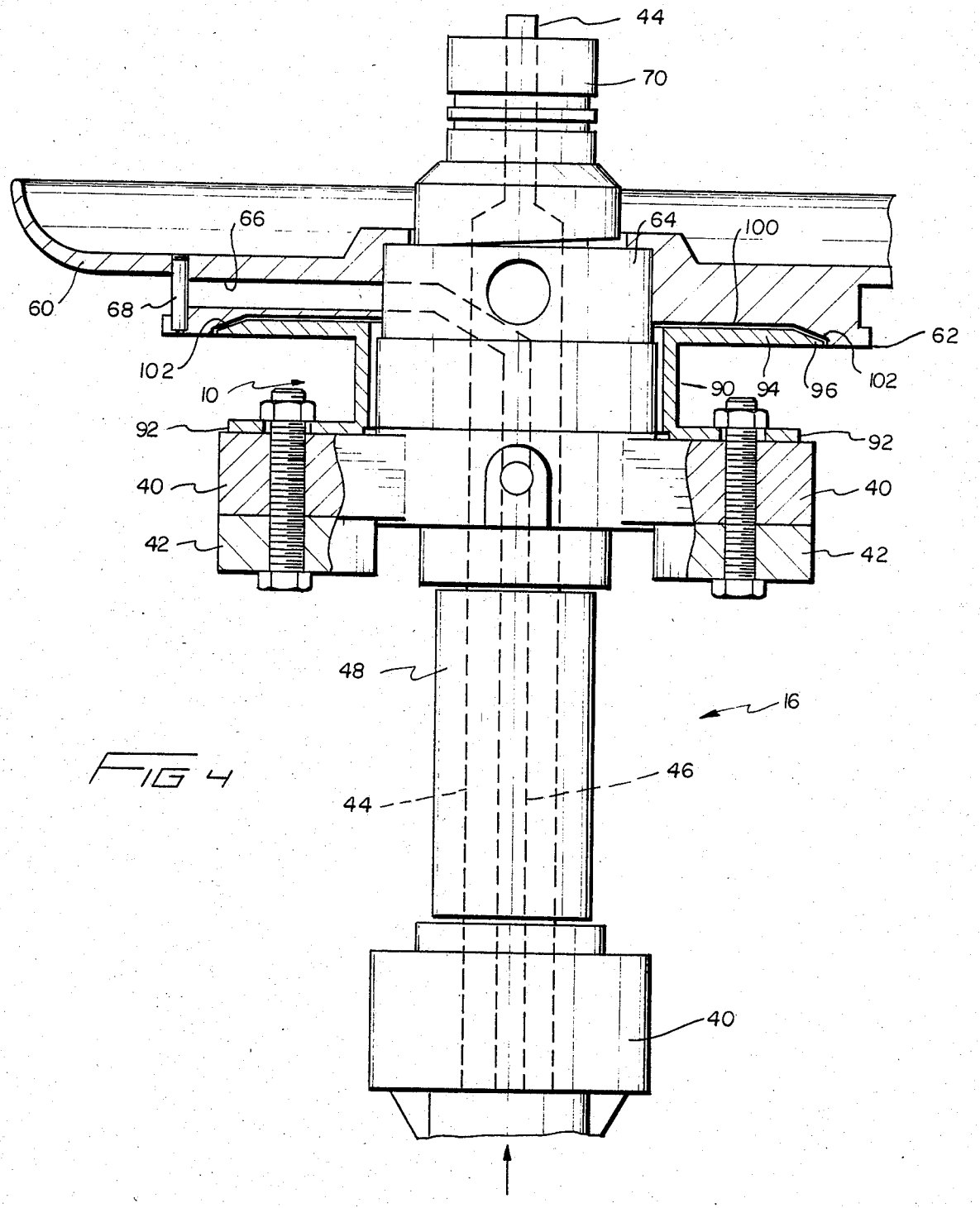
FIG. 4 is a longitudinal side view, partially in section, of a choke guard in accordance with the invention installed on a spindle.

Spindle 16, which is illustrated in more detail in FIG. 4, comprises a fixed generally U-shaped in FIG. 1) body 40 supported on the forked ends 42 of spindle mounting bracket 14. A hollow shaft 44 having an axially extending bore 46 is rotatably supported within the fixed body and has connected thereto a cylindrical roller 48, as of rubber. As shown in FIG. 1, a drive belt 50 is passed around cylindrical roller 48, over a pair of guide rollers 52, and around a drive roller 54 connected to a motor (not illustrated) for rotating the shaft.

As best illustrated in FIG. 4, a generally dish-shaped spindle disc 60 having a lower pedestal portion 62 is supported adjacent to the upper end of the spindle on a rotating member 64 connected to the spindle shaft. The spindle disc rotates with the shaft. A radially extending bore 66 is formed in the lower pedestal portion of the spindle disc and is in communication with the axial bore 46 of the shaft. A pair of rollers or rounded guides 68 (only one being shown in FIG. 4) may be located on either side of the outlet of radial bore 66. Bobbin carrier 18 is disposed within the dished-out portion of the spindle disc and is connected to an upper member 70 of the spindle which is rotatably mounted with respect to the shaft. In a well-known manner, the spindle is designed so that member 70 (and bobbin carrier 18) are held stationary with respect to the rotating shaft and spindle disc by a stabilization mechanism such as a stabilization whorl of the type disclosed in the afore-referenced U.S. Pat. No. 4,167,094 or by a system of magnets such as illustrated in U.S. Pat. No. 4,261,164. The details of such stabilization mechanisms are well known in the art and are omitted from FIG. 4 in order to avoid unnecessary complexity in the figure. The details of such mechanisms may be had by reference to these patents.

As shown in FIG. 1, one or more strands of yarn 80 may be unwound from bobbins or cones located in a creel (not illustrated) and fed through a guide tube 82 in the lower end of the spindle. The yarn passes upwardly through the axial bore of the spindle shaft and exits the radial bore of the spindle disc. The yarn is then fed upwardly through a balloon control ring 84, which surrounds carrier 18, and is passed through eyelet 24. By virtue of the rotation of the spindle disc, yarn 80 forms a well-known "balloon" about the carrier, and is twisted together in eyelet 24 with the yarn 20 being withdrawn from the bobbin to form a multiple-strand yarn 84 which is wound upon drum 28. As may be appreciated, if the yarn exiting the radial bore of the spindle disc should break, the end of the yarn could enter the spindle and become wrapped around its rotating parts, causing failure of the spindle. This is prevented by choke guard 10 of the invention.

Figure 2:
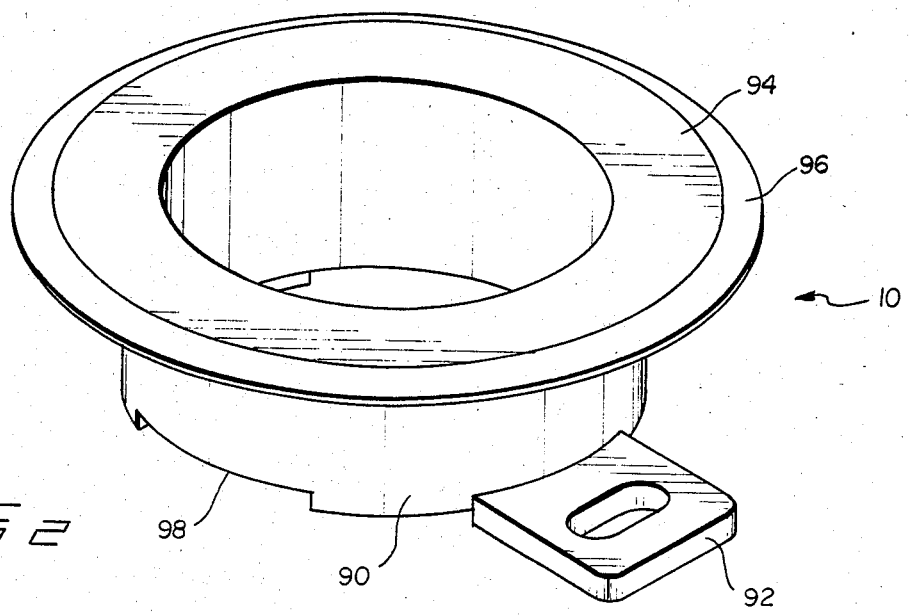
FIG. 2 is a perspective view of a choke guard in accordance with the invention.
Figure 3A:
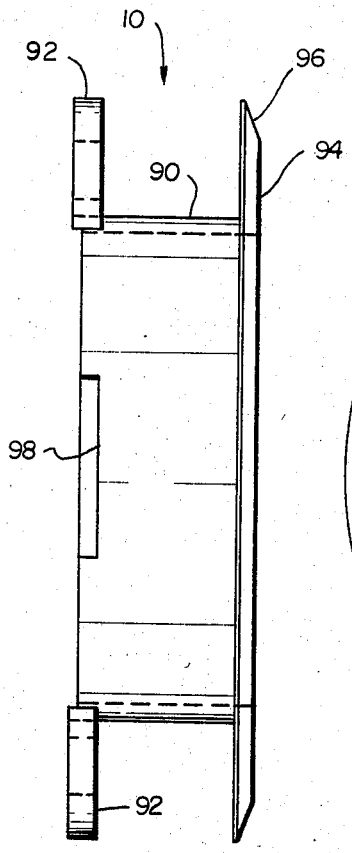
FIGS. 3A and 3B are, respectively, a side view and a bottom view of the choke guard of FIG. 2.
Figure 3B:
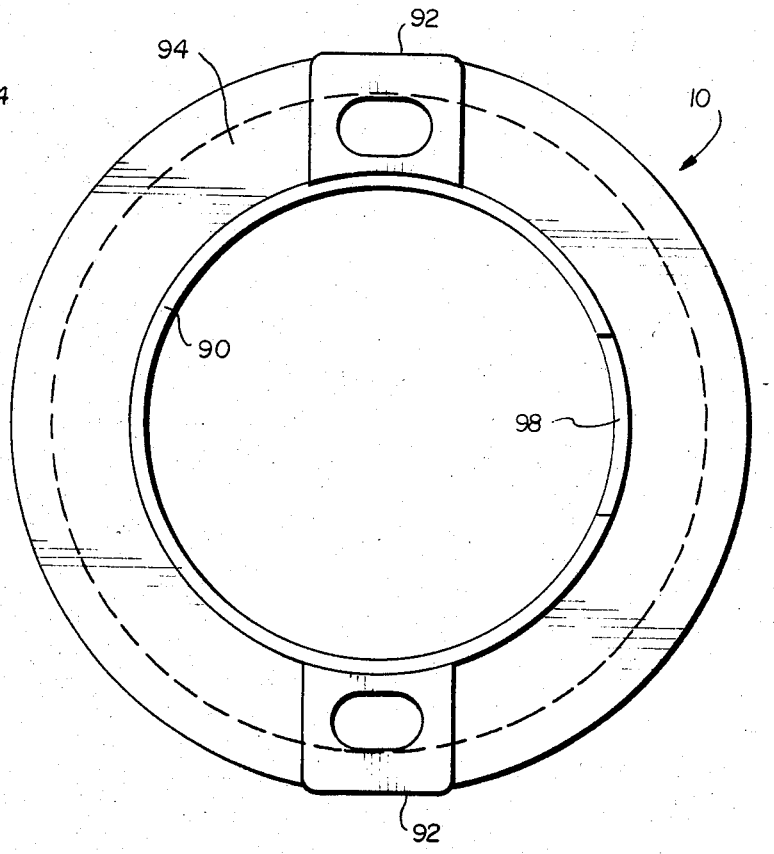

FIGS. 2–4 illustrate a choke guard 10 in accordance with the invention, FIG. 4 showing the choke guard installed on a spindle. As shown, the choke guard may comprise a cylindrical member 90 having a pair of slotted radially projecting flanges 92 at its lower end to enable connection of the choke guard to the fixed body 40 of the spindle, in the manner illustrated in FIG. 4, by the mounting bolts which secure the spindle body to the ends 42 of the mounting bracket. A circular radially projecting annular flange 94 having a chamfered upper edge 96 may be formed on the opposite end of the cylindrical member from the mounting flanges 92 as shown. The lower end of the cylindrical member 90 may have a notch 98 in its periphery to accomodate a protrusion on the spindle body so that the choke guard can be mounted with flanges 92 flush with the mounting portions of the spindle body 40, as shown in FIG. 4. The choke guard may be formed of any suitable material, such as steel, for example. In fact, the choke guard can be made out of any material that can withstand the heat and friction involved; other examples are plastic and aluminum.

As shown in FIG. 4, the cylindrical member of the choke guard is adapted to be disposed coaxially about the spindle between the bottom of the spindle disc and the top surface of the portion of the spindle body 40 that mounts the spindle to the ends 42 of the mounting bracket. The lower surface of the pedestal portion 62 of the spindle disc is formed with a circular recess 100 having beveled sides 102. Circular flange 94 is sized to be received within this recess, its chamfered edges 96 mating with the beveled sides 102 of the recess, and to provide a small clearance of the order of 0.010–0.015 inch to allow rotation of the spindle disc with respect to the choke guard. As also shown in FIG. 4, flange 94 preferably has a thickness such that its lower surface is substantially flush with the lower surface of the pedestal portion 62 of the spindle disc. This avoids a protrusion which could catch the end of broken yarn and enable the yarn to enter the clearance space between the choke guard and the spindle disc. As is also shown in the figure, the inner diameter of the cylindrical member 90 is greater than the diameter of the portions of the spindle enclosed by the circular member, so as to enable free rotation of the spindle portions with respect to the choke guard.

As may be appreciated, in the event yarn 80 breaks, its end will tend to become wrapped about the cylindrical member of the stationary choke guard, rather than entering the spindle and becoming wrapped about its rotating portions. Yarn wrapped about the choke guard may be easily removed and, in any event, would not interfere with the rotation of the spindle or cause its premature failure. Moreover, the choke guard serves conveniently as a cover to prevent dust and dirt from entering the rotating portions of the spindle.

While a preferred embodiment of the invention has been shown and described, it will be appreciated by those skilled in the art that changes may be made in this embodiment without departing from the principles and spirit of the invention, the scope of which is defined in the appended claims.

I claim:

1. For use with a twisting machine spindle of the type comprising a shaft rotatably supported in a fixed body, the shaft supporting a yarn carrier rotatably mounted on the top of the shaft and having an axial yarn-receiving bore communicating with a radially extending yarn exit bore in a disc connected to the shaft and spaced from the yarn carrier, the disc having a circular recess in a surface thereof, a choke guard for preventing broken yarn exiting the yarn exit bore from entering rotating portions of the spindle, the choke guard comprising a guard member sized to be disposed coaxially about the spindle and to extend between the fixed body and the disc, the guard member having means for connection to the fixed body and having a radially extending circular portion at one end thereof which is sized to be received entirely within the circular recess in the disc and to be substantially flush with respect to the surface of the disc in which said recess is located.

2. The choke guard of claim 1, wherein the recess in the disc has beveled sides, and the radially extending circular portion has chamfered edges which match the bevelled sides, the circular portion being sized with respect to the recess so as to afford a small clearance between the circular portion and the recess and to afford free rotation of the disc with respect to the choke guard.

3. The choke guard of claim 1, wherein said guard member further comprises a cylindrical portion disposed coaxially about the spindle and connected to the circular portion, and the diameter of the cylindrical portion is substantially less than the diameter of the circular portion.

4. The choke guard of claim 1, wherein said means for connection comprises radially projecting slotted flanges.

5. The choke guard of claim 1, wherein the guard member, the means for connection, and the radially extending circular portion are integrally formed.

6. The choke guard of claim 5, wherein the choke guard is formed of steel.

7. A twisting machine spindle comprising a shaft rotatably supported in a fixed body, the shaft carrying a radially extending disc which rotates with the shaft, the disc having a radial surface with a coaxial circular recess therein, a guard member disposed coaxially about the shaft between the fixed body and the rotating disc, the guard member having means for connecting the member to the fixed body and having a radially extending circular flange disposed entirely within the circular recess in said surface of the disc, the circular flange being sized such that it does not protrude beyond said circular recess in either a radial or an axial direction.

8. The spindle of claim 7, wherein said circular flange is sized so as to be flush with said surface of the disc when the flange is received within the recess.

9. The spindle of claim 7, wherein said circular recess has beveled sides, and said circular flange has chamfered edges so as to enable the flange to be received within the recess with a small clearance between the flange and the disc.

10. The spindle of claim 7, wherein the guard member further has a cylindrical portion extending coaxially about the shaft between the circular flange and the connecting means, the cylindrical portion having a diameter substantially less than the diameter of the circular flange.

* * * * *